US008112889B2

(12) United States Patent
Bich et al.

(10) Patent No.: US 8,112,889 B2
(45) Date of Patent: Feb. 14, 2012

(54) METHOD OF MANUFACTURING AN INK JET PRINTHEAD

(75) Inventors: Danilo Bich, Arnad (IT); Eliseo Chiaverina, Arnad (IT); Francesca Pescarmona, Arnad (IT); Paolo Schina, Arnad (IT)

(73) Assignee: Telecom Italia S.p.A., Milan (IT)

( * ) Notice: Subject to any disclaimer, the term of this patent is extended or adjusted under 35 U.S.C. 154(b) by 682 days.

(21) Appl. No.: 12/158,939

(22) PCT Filed: Dec. 23, 2005

(86) PCT No.: PCT/EP2005/013999

§ 371 (c)(1),
(2), (4) Date: Aug. 4, 2008

(87) PCT Pub. No.: WO2007/073755

PCT Pub. Date: Jul. 5, 2007

(65) Prior Publication Data

US 2008/0313901 A1 Dec. 25, 2008

(51) Int. Cl.
*B41J 2/16* (2006.01)
*B41J 2/165* (2006.01)

(52) U.S. Cl. ..... 29/890.1; 347/45; 427/578

(58) Field of Classification Search ..... 29/890.1; 427/577, 578; 347/44, 45, 47
See application file for complete search history.

(56) References Cited

U.S. PATENT DOCUMENTS

| | | | | |
|---|---|---|---|---|
| 4,532,150 | A * | 7/1985 | Endo et al. | 427/577 |
| 4,623,906 | A * | 11/1986 | Chandrashekhar et al. | 346/45 X |
| 6,126,277 | A | 10/2000 | Feinn et al. | |
| 6,155,674 | A | 12/2000 | Figueredo et al. | |
| 6,290,337 | B1 | 9/2001 | Radke | |
| 6,561,624 | B1 * | 5/2003 | Kikugawa et al. | 347/45 |
| 6,610,165 | B2 | 8/2003 | Myhill et al. | |
| 6,676,244 | B2 * | 1/2004 | Kwon et al. | 347/45 |
| 6,799,832 | B1 | 10/2004 | Adavikolanu et al. | |
| 6,821,571 | B2 | 11/2004 | Huang | |
| 2003/0155074 | A1 | 8/2003 | Yao | |
| 2004/0106271 | A1 | 6/2004 | Li et al. | |
| 2005/1009003 | | 4/2005 | Cui et al. | |

FOREIGN PATENT DOCUMENTS

| | | | | |
|---|---|---|---|---|
| EP | 1 306 215 | | 5/2003 | |
| EP | 1 3065 215 | A1 | 5/2003 | |
| JP | 59176054 | A * | 10/1984 | 347/45 |
| WO | WO-01/80309 | | 10/2001 | |

OTHER PUBLICATIONS

International Search Report issued in PCT/EP2005/013999 dated Sep. 25, 2006. Written Opinion issued in PCT/EP2005/013999 dated Sep. 25, 2006.

* cited by examiner

*Primary Examiner* — A. Dexter Tugbang
(74) *Attorney, Agent, or Firm* — Venable LLP; Robert Kinberg; Steven J. Schwarz

(57) ABSTRACT

A method of manufacturing an ink jet printhead, including: arranging a nozzle plate in which there is formed a plurality of nozzles, the nozzle plate having an upper surface and a lower surface, the upper surface being on the side of the ejection of ink drops and the lower surface being opposite to the upper surface; depositing on the upper surface a first coating including a first layer including silicon carbide, while maintaining the nozzle plate at a first deposition temperature not larger than 250° C.; depositing on the lower surface a second coating including a second layer including silicon carbide, while maintaining the nozzle plate at a second deposition temperature not larger than 250° C.; positioning the nozzle plate onto the ink barrier layer by bringing into contact the second coating layer with the ink barrier layer. The first layer is deposited before the second layer.

18 Claims, 3 Drawing Sheets

FIG 1
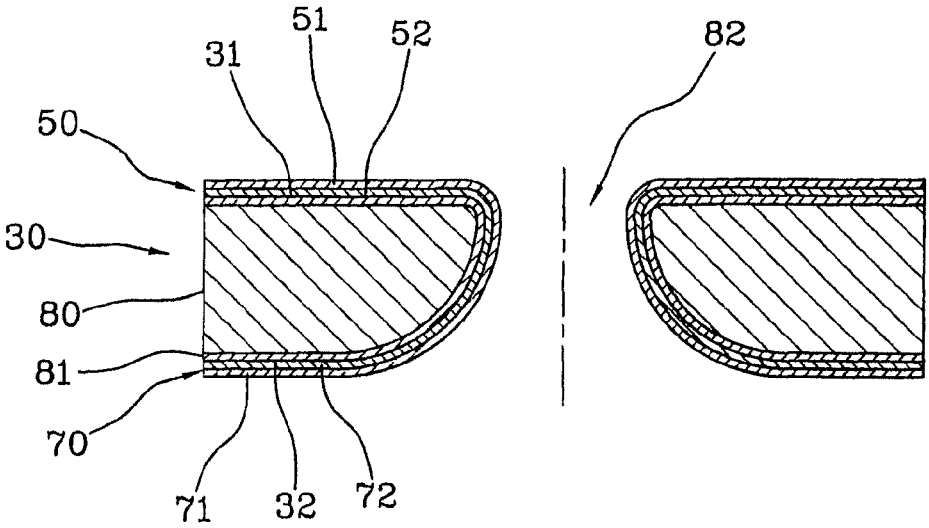
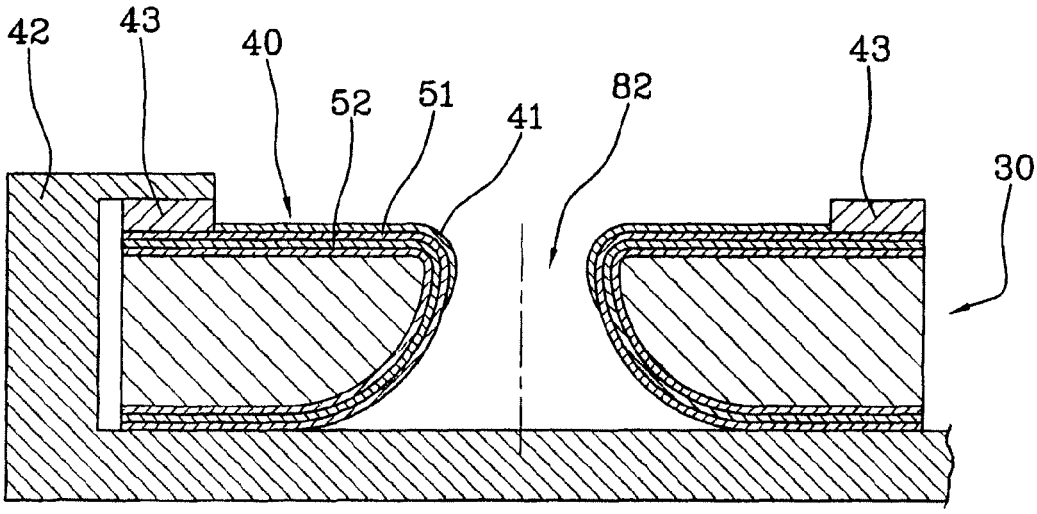
FIG 2

METHOD OF MANUFACTURING AN INK JET PRINTHEAD

CROSS-REFERENCE TO RELATED APPLICATIONS

This application is a National Stage Application of PCT/EP2005/013999, filed Dec. 23, 2005, which designates the United States.

TECHNOLOGICAL FIELD OF THE INVENTION

This invention relates to a method of manufacturing an inkjet printhead.

STATE OF THE ART

In inkjet printers, printing is effected through a printing head comprising a plurality of nozzles capable of selectively emitting drops of black or coloured ink onto the paper while the head moves alternately (forwards and backwards) and transversely with respect to the driven movement of the paper. In the case of inkjet printers of the thermal type, the head uses heating elements, generally resistors, which heat the ink in order to boil it and therefore cause the ink to be expelled through the nozzles during the printing operation.

In certain applications, such as for example in points of sale (POS) printing systems for issuing receipts, tickets or bank certificates, the paper used for inkjet printing is of the ordinary type. The possibility of using ordinary paper renders inkjet technology particularly advantageous because it is relatively economical, especially when printing in black and white.

In other applications, high-quality colour inkjet printing is required; in order to achieve a photographic-like quality printing, especially in four ink printing systems, ink drop volume needs to be reduced significantly, for example to about 3 picoliters, wherein non-photographic quality four ink systems commonly operate with a drop volume of about 30 picoliters. U.S. Pat. No. 6,126,277 discloses a thin-film inkjet printhead being configured to eject ink droplets having a volume of about 2-4 picoliters.

Ink is generally ejected through an orifice or nozzle formed through an orifice plate (or nozzle plate). Build-up of material at the nozzle may affect formation of the drop, attract dust or other micro-debris, and may also cause smearing of the ink. For this reason it may be desirable that the surface of the nozzle plate should have a low wettability with respect to the fluid ejected through the nozzle.

U.S. Pat. No. 6,610,165 describes a method for coating a nozzle plate with a non-wetting Teflon (PFTE) material formed by thermal compression.

Typically, an inkjet printhead includes an array of nozzles formed through a nozzle plate that is attached to an ink barrier layer which in turn is attached to a thin film structure that includes ink firing heating resistors and the electrical interconnections suitable to control the heating of firing resistors and thus the ejection of the ink drops from the nozzles. The film structure is generally formed on or within a semiconductor substrate, typically a silicon wafer.

The ink barrier layer defines ink channels including ink vaporisation chambers comprising heating resistors and the nozzles which are aligned with the associated ink chambers. The ink barrier layer is typically a polymer material that is laminated as a dry film to the underlying thin film structure, and is designed to be photosensible to UV radiation and to be thermally curable.

Therefore, within this printhead structure, the surface of the nozzle plate opposite to the "ejection surface" (i.e. the surface through which the ink drops are ejected) needs to be bonded to the lower thin film structure of the printhead.

U.S. Pat. No. 6,155,674 discloses an adhesion interface between a silicon carbide (SiC) layer of a thin film substrate and a polymer ink barrier layer in the vicinity of the ink chambers formed in the polymer barrier layer and an adhesion interface between a silicon carbide layer disposed on an orifice plate and ink barrier layer.

Silicon carbide has been used for instance as adhesion promoter material on low-k fluorinated amorphous carbon (a-F:C) layers in the production of large scale integrated circuits.

WO patent application No. 01/80309 describes a method to enhance the adhesion of silicon nitride to a low-k a-F:C layer, in which silicon carbide is used to promote such adhesion; in particular the adhesion layer is obtained by depositing a relatively hydrogen-free hydrogenated silicon carbide by PECVD using silane ($SiH_4$) and methane ($CH_4$) as the deposition gases. It is believed that the low level of hydrogen results in a more compact silicon carbide structure which resists breakdown at a temperatures up to and above 400° C.

In semiconductor processing methods, in particular for manufacturing MRAM circuitry, silicon carbide is used as etch stop material as the lowest portion of an insulating material. US patent application 2004/0106271 discloses a chemical vapour deposition (CVD) process for depositing SiC at low temperatures over a substrate at a temperature no greater than 500° and preferably not greater than 250°. It is pointed out that silicon carbide is typically very tenaciously adhered to the substrate on which it is deposited, in part due to its exposure to high temperatures during subsequent processing.

Silicon carbide layers in thin film technology can be deposited by chemical vapour deposition (CVD) or physical vapour deposition (PVD). A deposition process that is used in the manufacture of semiconductor devices for depositing SiC on various substrates is the plasma-enhanced chemical vapour deposition (PECVD).

US patent application 2005/0090036 discloses a PECVD process for depositing substantially oxygen-free SiC having a dielectric constant of less than about 4 by holding the substrate at a temperature lower than 100° C., preferably at about 25° C.

A PECVD process is also shown in U.S. Pat. No. 6,821,571, in which an exposed surface of a carbon containing material—such as silicon carbide—is treated with an inert gas plasma such as helium and argon, or an oxygen-containing plasma such as a nitrous oxide plasma. An improvement of the adhesion and oxidation resistance of the carbon-containing layer is in this way achieved.

Finally, silicon carbide films are useful in the fabrication of integrated circuits and printer printheads to provide corrosion resistant and protective layers over structures formed thereon. US patent application 2003/0155074 discloses a plasma enhanced chemical vapor deposition (PECVD) of SiC, in which silane gas ($SiH_4$), methane gas ($CH_4$) and a noble gas (such as helium or argon) are used for obtaining a SiC layer having low hydrogen concentration; the temperature at which the process is carried out is comprised between 150° and 600°.

Both abrasion and deformation of the nozzle plate can occur during contact between the head and the other structures encountered in the printing operation, such as cleaning structures. The problem of the durability of the head is particularly present in the case of nozzle plates made of non-metal polymer material. EP patent application No. 1306215 describes a coating layer on at least one of the upper or lower surfaces of a nozzle plate to render the head more robust. Coating materials such as silicon nitride ($Si_3N_4$), boron nitride (BN), silicon oxide ($SiO_2$), silicon carbide (SiC) and a composition known as "silicon carbon oxide" are used for this purpose.

SUMMARY OF THE INVENTION

This invention relates to a method of manufacturing an inkjet printhead.

The printhead comprises a substrate, an ink barrier layer formed on the substrate and a nozzle plate arranged over the ink barrier layer. According to the preferred embodiments, the inkjet printhead comprises a metal nozzle plate, although the present invention is understood to envisage also printheads comprising a nozzle plate made of polymeric material.

The Applicant has considered that if the surface of the nozzle plate through which the ink drops are ejected (i.e., the ejection surface), that is the surface with which the drops come into contact, is sufficiently wetting-resistant (or anti-wetting), the drops will spread to a lesser extent, and the printing quality will significantly increase.

The Applicant has found that a wetting-resistant surface coating of silicon carbide on the ejection surface of the nozzle plate ensures that the nozzle plate has stable non-wettability properties in the course of the printing operation.

In particular, the lack of deterioration in the wetting-resistance properties of the SiC coating has the advantage of reducing the number of cleaning operations necessary in order to continue the printing operation, with consequent extension of the service life of the head. Also, if the surface of the plate has a wetting-resistant SiC coating, cleaning operations have a positive effect in removing printing residues without risking deterioration of the quality of printing subsequent to that operation.

When a SiC coating layer is present on the ejection surface of the nozzle plate, it has been observed that the drops remain close to the holes, and as a result of transitory hydraulics following ejection, are partly drawn back within the nozzle, with consequently less ink on the surface of the nozzle plate.

The property of the wettability (or non-wettability) of the surface of the nozzle plate may be evaluated by measuring the contact angle $\alpha$, between a drop of ink and the surface of the nozzle plate. FIG. 5 illustrates schematically the formation of a drop 23 on an upper surface 26 of a nozzle plate 28. Angle $\alpha$ corresponds substantially to the angle which the tangent 24 to the surface of the drop 23 at a point P of the contact line between the surface of the drop 23 and the upper surface of the head 26 forms with the plane of the upper surface of the head 26. The greater the value of $\alpha$, the more the spreading of the drop is restricted, and the drop has well-defined perimeters. In other words, the higher the value of $\alpha$, the more the drop is in contact with a less-wettable surface (for the same surface tension of the fluid forming the drop).

Preferably, the contact angle $\alpha$ of the wetting-resistant layer will not be less than approximately 45°.

The Applicant has considered that silicon carbide may exhibit adhesion properties such that a silicon carbide containing layer can be effectively used to enhance adhesion between the nozzle plate and the lower structure of the printhead, comprising a substrate and an ink barrier layer formed on the substrate.

The nozzle plate includes an upper surface and a lower surface, said upper surface being on the side of the ejection of ink drops and said lower surface being opposite to said upper surface.

According to the present invention, a wetting-resistant coating layer comprising silicon carbide is deposited on the upper surface of the nozzle plate and an adhesion promoting coating layer comprising silicon carbide is deposited on the lower surface of the nozzle plate, which is the surface that will face the underlying printhead structure.

Both the wetting-resistant layer and the adhesion layer are preferably obtained by chemical vapor deposition (CVD), more preferably by plasma enhanced chemical vapor deposition (PECVD).

The Applicant has found that adhesion of a SiC-comprising layer, in particular to the ink barrier layer, depend on the temperature a which the layer is formed.

The Applicant has observed that adhesion between a silicon carbide layer, which is deposited on a nozzle plate, and the ink barrier layer is not satisfactory if the silicon carbide layer has been deposited by a CVD process wherein the nozzle plate was held at about 300° C.

Since coating layers need to be formed on two opposite surfaces of the nozzle plate, at least two deposition process steps are to be carried out. The Applicant has found that the sequential order of the deposition process steps to be carried out to form the wetting-resistant coating layer and the adhesion coating layer is a crucial parameter in order to avoid the risk of deteriorating the adhesion properties of the SiC.

In particular, the Applicant has verified that if a first SiC-comprising coating layer is obtained in a first deposition step, and a second SiC-comprising coating layer is obtained in a second deposition step, following the first deposition step, the adhesion properties of the first coating layer are to a large extent lost after the second deposition step.

This has been found to occur also when the temperature at which the second deposition step is performed is substantially the same as the temperature at which the first deposition process step is carried out. The loss of the adhesion properties of the firstly-deposited coating layer after deposition of the second coating layer is deemed to be due to the additional thermal treatment undergone by the adhesion layer during the second deposition process step.

In particular, it was observed that the adhesion properties of a SiC-comprising coating layer deposited at about 150° C. were not maintained when the nozzle plate was further thermally treated during a second deposition process step, wherein the temperature of the nozzle plate was raised again and set to about 150° for more than about 20 minutes.

The Applicant has found that suitable adhesion properties of a SiC-containing layer can be achieved at deposition temperatures not larger than about 250° C. Preferably, deposition is carried out at a temperature comprised between 50° C. and 200° C., more preferably comprised between 100° C. and 150° C.

The Applicant has understood that if the wetting-resistant layer is realized first, and the adhesion layer is obtained successively, the adhesion properties of the adhesion layer are mostly maintained.

Advantageously, the wetting-resistant properties of the SiC-comprising layer deposited on the upper surface of the nozzle plate are not prejudiced by a successive thermal treating caused by a CVD process, e.g., carried out for deposition of a second SiC-comprising layer.

According to a preferred embodiment, the deposition process steps for forming the wetting-resistant coating layer and the adhesion layer are substantially identical, i.e., the deposition parameters are substantially the same for both process steps presumably resulting in two coating layers having essentially the same structural properties. In this way, the method of manufacturing an inkjet printhead can be costeffective, since by carrying out twice the same CVD process, it is possible to obtain two coating layers on two opposite surfaces of the nozzle plate having different properties.

BRIEF DESCRIPTION OF THE FIGURES

FIGS. 1-4 show a schematic detail of a printhead undergoing different steps of the method according to a preferred embodiment of the present invention.

DETAILED DESCRIPTION

Figure 3:
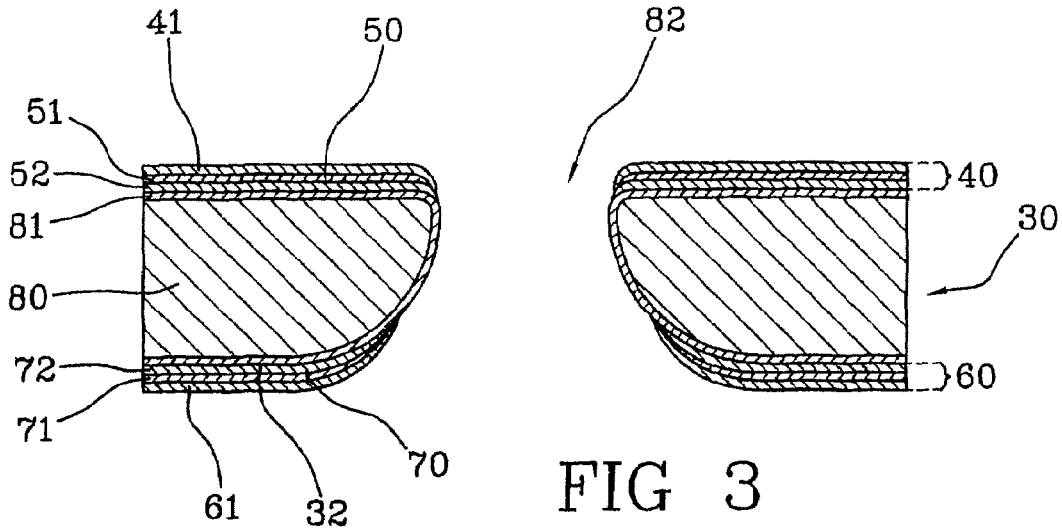

In the preferred embodiment of the invention the method of printing uses an inkjet printing head of the "top shooter" thermal type, that is one which emits ink drops in a direction substantially perpendicular to the ejection members, i.e., the nozzles.

With reference to the figures, an inkjet printhead manufactured by the method according to the present invention is generally indicated at 1.

FIGS. 1-4 show a schematic section of two portions of the nozzle plate 30, between which a nozzle 82 is defined.

With reference to FIG. 1, the method according to the present invention comprises a step of arranging a nozzle plate 30 comprising a plurality of nozzles 82 (only one nozzle is shown in FIG. 1) from which ink droplets directed against a printing medium, which is generally paper (not shown), are ejected. The nozzle plate comprises an upper surface 31 and a lower surface 32, said upper surface 31 being the surface facing the side where ink droplets are emitted.

The lower surface 32 is the surface of the nozzle plate 30 which is opposite to the upper surface 31 and which will be placed into contact with the remaining portion of the printhead 1 in a successive process step.

Nozzle plate 30 is preferably of metal, more preferably of Au-coated nickel. In FIG. 1, a galvanic nickel plate (grown for example by electroforming) 80 is coated with a layer of galvanic gold 81 again obtained, for example, by electroforming. Preferably, a layer of gold 52 and 72, respectively, having a thickness of some nm (for example 2-5 nm), is deposited by sputtering onto both the upper and lower surfaces of the Au-coated plate, i.e., on layer 81. Preferably the surface of the galvanic Au layer 81 is treated by sputter etching using argon gas plasma in order to clean the surface before deposition of Au layers 52 and 72 by sputtering.

According to a preferred embodiment, the method comprises a first deposition step on the upper surface 31 of a first coating 40, including a first layer 41 comprising silicon carbide. Said first coating layer is a wetting-resistant layer. Preferably, the first coating layer 41 is formed by PECVD. During deposition of the first coating layer 41, the nozzle plate 30 is held at a first temperature not larger than 250° C.

In the example illustrated in FIG. 2, the nozzle plate 30 is held during the first deposition step by means of a holder 42 in order to secure a mask 43 (e.g., a metallic masking layer) on the upper surface 31 of the nozzle plate. Mask 43 protects some areas of the nozzle plate 30 from the deposition of the first SiC-comprising layer 41, for instance the surface areas where alignment marks (not shown) are present. Alignment marks can be optionally used to align the nozzle plate with the underlying substrate before bonding of the nozzle plate to the ink barrier layer, as described more in detail in the following. Alignment between the nozzle plate and the underlying structure can be carried out by means of a standard optical alignment technique. It has been observed that alignment marks tend to be difficult to detect under optical beam through SiC layers.

The holder can also function as supporting substrate during deposition for more than one nozzle plate.

The first coating layer comprising silicon carbide 41 deposited on the upper surface 31 of the nozzle plate functions as wetting-resistant layer. It is deposited at least on the surface areas in the vicinity of and corresponding to the nozzles 82. In this way, the ink-contact surface on which the ink droplets is in contact with has wetting resistant properties.

Preferably, the first SiC-containing coating layer 41 is deposited on substantially the whole upper surface 31 of the nozzle plate 80, optionally with the exception of very small surface areas (e.g., not larger than 1-2% of the upper surface of the nozzle plate) containing alignment marks, which are not in the vicinity of the ink-ejection areas.

Preferably, the first SiC layer 41 can be approximately 30-40 nm thick.

Preferably, the temperature at which the nozzle plate is maintained during the deposition of the first SiC-comprising coating layer 41, i.e., the first deposition temperature, is comprised between 50° C. and 200° C., and more preferably is comprised between 100° C. and 150° C.

Precursor gases for forming SiC-comprising coating layer 41 comprise methane gas ($CH_4$), and silane gas ($SiH_4$) 5% diluted with Argon ($SiH_4$/Ar 5%).

For example, methane is introduced in the deposition chamber with a flow rate of about 50 sccm, whereas the flow rate of the $SiH_4$/Ar mixture is of about 150 sccm. Pressure in the deposition chamber can be of about 750 milli Torr, while the power supplied (at low frequency) is of about 44 W. Deposition temperature is of about 150° C.

Due to the relatively low deposition temperature and the deposition parameters, it is believed that the film deposited using the parameters of the above described example is substantially an hydrogenated silicon carbide ($SiC_xH_y$) layer.

According to a preferred embodiment, before the deposition of the first coating SiC-comprising layer 41, the step of depositing said first coating 40 comprises a step of covering the upper surface 31 of the nozzle plate 30 with a first intermediate layer 50 for improving the adhesion between sputtered Au-film 52 and the first SiC-comprising coating layer 41.

The first intermediate layer 50 comprises a film of tantalum 51. The tantalum film can be deposited by sputtering with a thickness comprised between 30 nm and 50 nm.

By means of the above described first deposition of the first SiC-coating layer 41, a wetting-resistant coating is realized on the upper surface 31 of the nozzle plate 30, thereby forming a wetting resistant ejection surface. The contact angle $\alpha$ of the first coating layer 41 was measured to be comprised between 40° and 500°. Measurements of the contact angle mentioned in the present description can be obtained at ambient temperature (22-25° C.) using a commercial OCA 20 static angle measuring system distributed by FKV, depositing a drop of liquid on the surface of the nozzle plate using a micropipette.

Following the deposition of a first SiC-comprising coating layer, the method according to the present invention further comprises a step of depositing on the lower surface 32 of the nozzle plate 30 a second coating 60 including a second SiC-comprising layer 61 (FIG. 3).

During deposition of the second coating layer 60 the nozzle plate 30 is maintained at a temperature (i.e., the second deposition temperature) not larger than about 250° C.

Before the second deposition step, the nozzle plate is positioned preferably in the deposition chamber so as to have the lower surface 32 facing the gases used during deposition. After the first deposition step, the nozzle plate 30 is removed from holder 42 and it is placed on a heater block (not shown) inside the deposition chamber with the surface coated by layer 41 facing the heater block.

Preferably the second deposition temperature is comprised between 50° C. and 200° C., more preferably is comprised between 100° C. and 150° C.

According to a preferred embodiment, the first and second deposition temperatures are substantially equal to each other.

By means of the above described second deposition, an adhesive coating is realized on the lower surface 32 of the nozzle plate 30, so that the latter can be reliably engaged with the underlying portion of the printhead 1, as described more in detail in the following.

In the preferred embodiment, the deposition of the second layer 61 is obtained by means of a Chemical Vapor Deposition (CVD) process and, in particular, by means of a Plasma Enhanced Chemical Vapor Deposition (PECVD) process.

Precursor gases for forming SiC-comprising coating layer 41 comprise methane gas ($CH_4$), and silane gas ($SiH_4$) 5% diluted with Argon ($SiH_4$/Ar 5%).

For example, methane is introduced in the deposition chamber with a flow rate of about 50 sccm, whereas the flow rate of the $SiH_4$/Ar mixture is of about 150 sccm. Pressure in the deposition chamber can be of about 750 milli Torr, while the power supplied (at low frequency) is of about 44 W. Deposition temperature is of about 150° C.

At the end of the second deposition step, the second SiC layer 61 can be approximately 30-40 nm thick.

Preferably, the deposition parameters defining the second deposition step are substantially the same as the deposition parameters defining the first deposition step for forming the first SiC-coating layer.

According to a preferred embodiment, before the deposition of the second SiC-comprising layer 61, the step of depositing said second coating 60 comprises a step of covering the lower surface 32 of the nozzle plate 30 with a second intermediate layer 70, for improving the adhesion between sputtered Au-film 72 and the second SiC-comprising coating layer 61.

The second intermediate layer 70 comprises a film of tantalum 71. The tantalum film can be deposited by sputtering with a thickness comprised between 30 nm and 50 nm.

Preferably, the second coating layer (i.e., the adhesive layer) 61 covers substantially the whole lower surface 32 of the nozzle plate 30. It is to be noted that the first coating layer 41 is deposited before the second coating layer 61. In other words, the deposition of the second layer 61 is carried out after the deposition of the first layer 41 is completed.

The nozzle plate 30 comprising a wetting-resistant coating layer on its upper surface and an adhesion-promoting layer on its lower surface is brought into contact to the underlying portion of printhead 1. In particular, the lower surface of the nozzle plate coated with SiC-comprising layer 61 is brought into contact to the underlying portion of the printhead.

Figure 4:
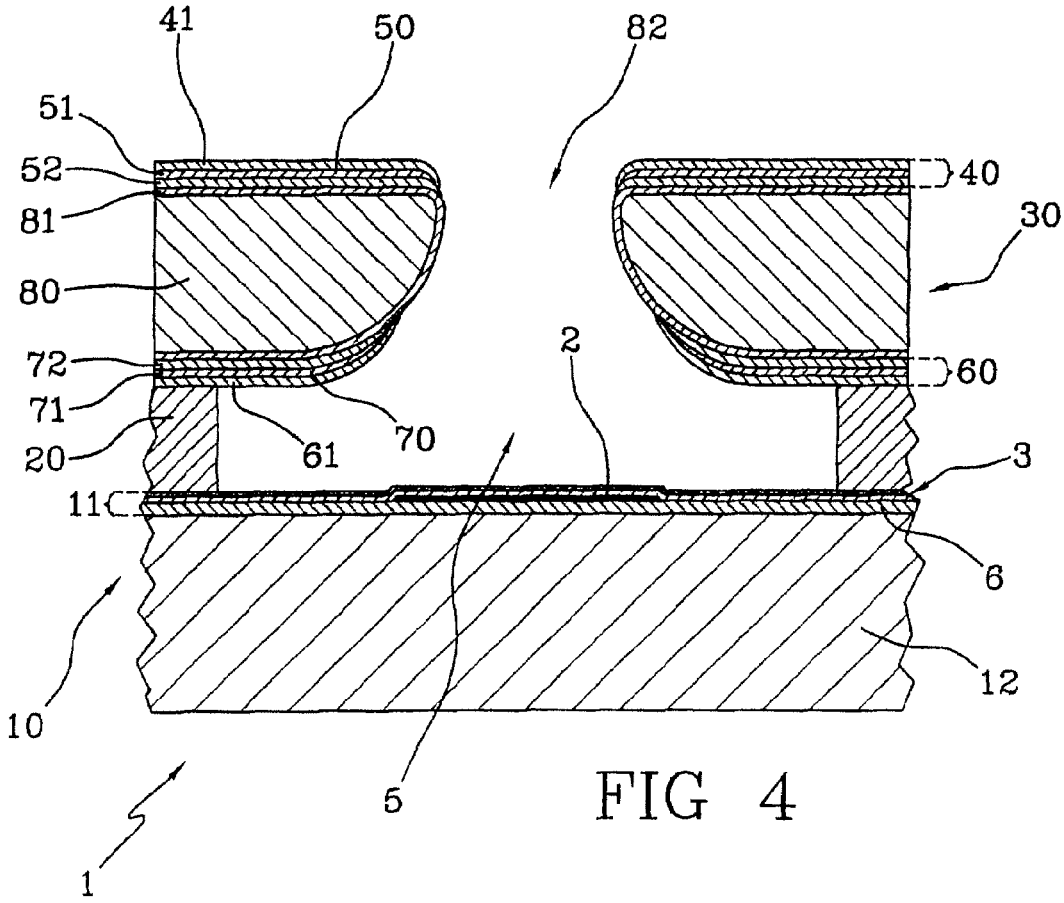
Figure 5:
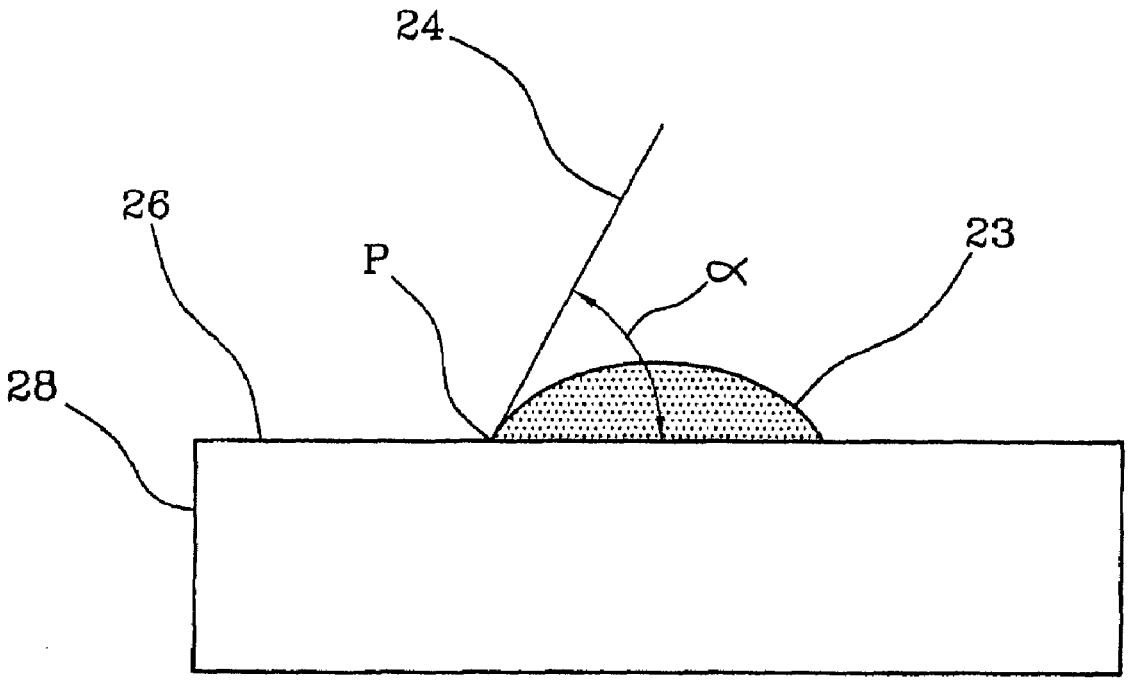
FIG. 5 is a schematic representation of the contact angle of a drop on the ejection surface of a nozzle plate.

FIG. 4 illustrates a partial transverse cross-section of a printhead 1 obtained by a process according to a preferred embodiment of the invention illustrated in FIGS. 1-3. The same reference numerals are given to elements of the nozzle plate corresponding to those shown in FIGS. 1-3 and their description is omitted.

The printhead 1 comprises substrate 10 and an ink barrier layer 20 formed on such a substrate 10.

Preferably, substrate 10 comprises a silicon substrate 12 (typically formed from a crystalline silicon wafer) on which there is formed a thin-film structure 11. The thin-film structure 11 comprises a layer of silicon oxide 6 formed within the upper surface of the silicon substrate 12 and a plurality of heating elements 2 (only one element is illustrated in FIG. 3), for example resistors of Ta/Al, which are deposited on the silicon oxide surface 6. The film-film structure 11 further comprises a layer or a plurality of protective layers 3, for example a Ta/SiC/$Si_3N_4$ multilayer, which covers the resistors 2 in order to protect them.

Each nozzle 82 is positioned in relation to a chamber 5 where a bubble of vapour forms following heating of resistor 2.

The ink barrier layer 20 in which are provided chambers 5 and conduits (not shown) through which the ink flows to the chambers from an ink reservoir fed by a cartridge (not shown).

Preferably, the ink barrier layer 20 is a polymeric layer laminated as a dry film on the thin-film structure 11. More preferably, the polymeric layer is photosensitive and a pattern can be defined in the layer by exposure to UV radiation and subsequent thermal curing.

After the deposition of the second coating layer 61 is completed, the nozzle plate 30 is arranged onto the ink barrier layer 20, by bringing into contact the second coating layer 61 with the ink barrier layer 20. Thanks to the adhesive properties of the silicon carbide included in the second coating layer 61, the nozzle plate 30 and the ink barrier layer 20 can be reliably bonded to one another.

Preferably, bonding between the second coating layer 61 and the ink barrier layer 20 is obtained by a thermo-compression process. During this process, the SiC-coating layer 61 is urged against the upper surface of the ink barrier layer 20 by means of known spring devices, such as one or more spring clips. After the mechanical contact between the layers is achieved, the printhead 1 preferably undergoes an additional thermal treatment, during which the nozzle plate 30 (and the underlying layers) is heated at a annealing temperature.

The annealing temperature is advantageously higher than said first and second temperatures; in the preferred embodiment, the third temperature is comprised between 140° C. and 180° C., more preferably between 155° C. and 165° C.

According to a preferred embodiment, first and second deposition temperatures are of about 150° C., whereas the annealing temperature is of about 160° C. Annealing time can be of about 1 h.

At the end, the nozzle plate 30 is properly bonded to the underlying portion of the printhead 1 (namely, the ink barrier layer 20 and the substrate 10).

It has been noted that a post-deposition annealing of the nozzle plate can improve the wetting-resistant properties of the first SiC-comprising coating layer.

An increase of the contact angle $\alpha$ of the first layer 41 by approximately 10° was observed after annealing at 160° C. for about 1 h, so that contact angles between the ejection surface and the ink droplets of about 50°-60° could be obtained.

If post-deposition annealing is carried out while the second SiC-comprising coating layer (i.e., the adhesion layer) is maintained in mechanical contact to the ink barrier layer, it has been noted that the adhesion properties of the adhesion layer do not significantly deteriorate. In fact, a reliable bonding (supposedly through a chemical bonding reaction) between the two layers has been observed to take place.

The invention claimed is:

1. Method of manufacturing an ink jet printhead, said printhead comprising a substrate and an ink barrier layer formed on said substrate, said method comprising the steps of:

arranging a nozzle plate in which there is formed a plurality of nozzles suitable for the ejection of ink drops, said nozzle plate comprising an upper surface and a lower surface, said upper surface being on the side of the ejection of ink drops and said lower surface being opposite to said upper surface;

depositing on said upper surface a first coating including a first layer comprising silicon carbide, while maintaining said nozzle plate at a first deposition temperature not larger than 250° C.;

depositing on said lower surface a second coating including a second layer comprising silicon carbide, while maintaining said nozzle plate at a second deposition temperature not larger than 250° C.;

positioning said nozzle plate onto said ink barrier layer by bringing into contact said second coating layer with said ink barrier layer;

wherein said first layer is deposited before said second layer, and wherein said first layer and said second layer are distinct and separated from each other on said nozzle plate.

2. Method according to claim 1, further comprising a step of heating said nozzle plate at an annealing temperature comprised between 140° C. and 180° C. after said second layer is brought in contact with said ink barrier layer.

3. Method according to claim 2, wherein said annealing temperature is higher than said first and second deposition temperatures.

4. Method according to claim 2, further comprising:

pressing against each other said second coating layer and said ink barrier layer;

maintaining said nozzle plate at said annealing temperature while said second layer and said ink barrier layer are pressed against each other.

5. Method according claim 1, wherein said nozzle plate is made of Au-coated nickel.

6. Method according to claim 1, in which the step of depositing said first coating comprises depositing on said upper surface a first intermediate layer for adhesion between said upper surface and said first layer.

7. Method according to claim 6, in which said first intermediate layer comprises a film of tantalum.

8. Method according to claim 7, wherein the step of depositing said first intermediate layer comprises depositing a film of gold before deposition of the film of tantalum of said first intermediate layer.

9. Method according to claim 1, in which the step of depositing said second coating comprises depositing on said lower surface a second intermediate layer for adhesion between said lower surface and said second layer.

10. Method according to claim 9, in which said second intermediate layer comprises a film of tantalum.

11. Method according to claim 10, wherein the step of depositing said second intermediate layer comprises a step of depositing a film of gold before deposition of the film of tantalum of said second intermediate layer.

12. Method according to claim 1, wherein said first and second deposition temperatures are substantially equal to each other.

13. Method according to claim 1, wherein said first deposition temperature is comprised between 50° C. and 200° C.

14. Method according to claim 13, wherein said first deposition temperature is comprised between 100° C. and 150° C.

15. Method according to claim 1, wherein said second deposition temperature is comprised between 50° C. and 200° C.

16. Method according to claim 15, wherein said second deposition temperature is between 100° C. and 150° C.

17. Method according to claim 1, wherein said first layer comprises an anti-wetting layer and said second layer comprises an adhesion layer.

18. Method according to claim 17, wherein anti-wetting properties of said anti-wetting layer are maintained during deposition of said adhesion layer.

* * * * *